US005661456A

United States Patent [19]

Staehle, Jr.

[11] Patent Number: 5,661,456

[45] Date of Patent: Aug. 26, 1997

[54] THEFT PREVENTIVE PURSE

[76] Inventor: Daniel F. Staehle, Jr., 30 Tocci Ave., Monmouth Beach, N.J. 07750

[21] Appl. No.: 617,553

[22] Filed: Mar. 19, 1996

[51] Int. Cl.[6] ..... G08B 13/14

[52] U.S. Cl. ..... 340/571; 340/568; 340/825.32

[58] Field of Search ..... 340/571, 568, 340/691, 574, 543, 825.31, 825.32

[56] References Cited

U.S. PATENT DOCUMENTS

| | | | |
|---|---|---|---|
| 3,893,096 | 7/1975 | Tucci et al. | 340/571 |
| 3,938,126 | 2/1976 | Ransom | 340/571 |
| 4,755,802 | 7/1988 | Urbanczyk | 340/571 |
| 5,027,105 | 6/1991 | Dailey et al. | 340/571 |
| 5,153,561 | 10/1992 | Johnson | 340/571 |

*Primary Examiner*—Jeffery Hofsass
*Assistant Examiner*—Anh La

[57] ABSTRACT

A theft preventive purse comprising an opening with a keypad situated adjacent thereto with the keypad adapted to transmit an access signal for a predetermined amount of time upon the entry of a proper code. Also included is a trip switch comprising a first contact coupled adjacent to the opening and a second contact also coupled adjacent to the opening whereby the contacts abut upon the closure of the opening thus allowing current to pass therebetween. Also situated on the purse is a panic button adapted to emit an activation signal upon the depression thereof. A speaker is adapted to deploy an alarm upon the actuation thereof. Finally, control circuitry is situated within the purse and is electrically connected to the keypad, trip switch, and speaker. The control circuitry is adapted to apply a voltage to the trip switch and further actuate the speaker upon the detection of an absence of current therethrough with the coincident detection of an absence of the access signal. The control circuitry is also adapted to actuate the speaker upon the receipt of the activation signal via the panic button.

1 Claim, 3 Drawing Sheets

THEFT PREVENTIVE PURSE

BACKGROUND OF THE INVENTION

1. Field of the Invention

The present invention relates to a theft preventive purse and more particularly pertains to sounding an audio alarm upon the unauthorized access to a purse or depression of a panic button.

2. Description of the Prior Art

The use of purse alarms is known in the prior art. More specifically, purse alarms heretofore devised and utilized for the purpose of preventing the theft thereof are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,001,462 to Seemann et al. a personal safety alarm and light positionable along the interior of the purse or the like. U.S. Pat. No. 4,885,570 to Chien discloses a purse including a wavy wire fully distributed on a purse casing and an alarm formed in the casing for sounding an alarm in response to cutting of the wire. U.S. Pat. No. Des. 343,060 to Diaz et al. discloses a purse with built-in alarm, indicator light and mini-light. U.S. Pat. No. 4,633,232 to Nelson et al.; U.S. Pat. No. Des. 278,318 to Levin et al.; and U.S. Pat. No. 4,376,935 to Castaldo are provided as being of general interest.

In this respect, the theft preventive purse according to the present invention substantially departs from the conventional concepts and designs of the prior art, and in so doing provides an apparatus primarily developed for the purpose of sounding an audio alarm upon the unauthorized access to a purse or depression of a panic button.

Therefore, it can be appreciated that there exists a continuing need for a new and improved theft preventive purse which can be used for sounding an audio alarm upon the unauthorized access to a purse or depression of a panic button. In this regard, the present invention substantially fulfills this need.

SUMMARY OF THE INVENTION

In view of the foregoing disadvantages inherent in the known types of purse alarms now present in the prior art, the present invention provides an improved theft preventive purse. As such, the general purpose of the present invention, which will be described subsequently in greater detail, is to provide a new and improved theft preventive purse which has all the advantages of the prior art and none of the disadvantages.

To attain this, the present invention essentially comprises a purse with a generally rectangular configuration having a front face, a rear face, a bottom surface, and a pair of side edges formed therebetween defining an interior space. The purse comprises an openable access slit formed between the front face and rear face at an upper extent thereof. For carrying purposes, a handle is coupled to and extended upward from the side edges of the purse. Also included is a keypad comprising a plurality of keys situated on the front face of the purse adjacent to the slit. The keypad is adapted to transmit an access signal for a predetermined amount of time upon the depression of a predetermined set of keys in succession. Discreetly situated within the interior space of the purse is a trip switch. The trip switch comprises a first contact coupled to an inner surface of the front face adjacent to the slit. A second contact is coupled to an inner surface of the rear surface adjacent to the slit wherein the contacts abut upon the closure of the slit thus allowing current to pass therebetween. A panic button is positioned on the front face of the purse adjacent to the slit. The panic button is adapted to emit an activation signal upon the depression thereof. Further included is a speaker situated on one of the side edges of the purse. Upon the actuation thereof, the speaker is adapted to deploy a loud audio signal therefrom. Finally, control circuitry is situated within the interior space of the purse and electrically connected to the keypad, trip switch, panic button, and speaker via a plurality of discreet control lines. The control circuitry is adapted to apply a voltage to the trip switch and further actuate the speaker upon the detection of an absence of current therethrough with a coincident absence of the access signal. Also, the control circuitry is adapted to actuate the speaker upon the receipt of the activation signal via the panic button.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved theft preventive purse which has all the advantages of the prior art purse alarms and none of the disadvantages.

It is another object of the present invention to provide a new and improved theft preventive purse which may be easily and efficiently manufactured and marketed.

It is a further object of the present invention to provide a new and improved theft preventive purse which is of a durable and reliable construction.

An even further object of the present invention is to provide a new and improved theft preventive purse which is susceptible of a low cost of manufacture with regard to both materials and labor, and which accordingly is then susceptible of low prices of sale to the consuming public, thereby making such theft preventive purses economically available to the buying public.

Still yet another object of the present invention is to provide a new and improved theft preventive purse which provides in the apparatuses and methods of the prior art some of the advantages thereof, while simultaneously overcoming some of the disadvantages normally associated therewith.

Still another object of the present invention is to sound an audio alarm upon the unauthorized access to a purse or depression of a panic button.

Lastly, it is an object of the present invention to provide a new and improved theft preventive purse comprising an opening with a keypad situated adjacent thereto with the keypad adapted to transmit an access signal for a predetermined amount of time upon the entry of a proper code. Also included is a trip switch comprising a first contact coupled adjacent to the opening and a second contact also coupled adjacent to the opening whereby the contacts abut upon the closure of the opening thus allowing current to pass therebetween. Also situated on the purse is a panic button adapted to emit an activation signal upon the depression thereof. A speaker is adapted to deploy an alarm upon the actuation thereof. Finally, control circuitry is situated within the purse and is electrically connected to the keypad, trip switch, and speaker. The control circuitry is adapted to apply a voltage to the trip switch and further actuate the speaker upon the detection of an absence of current therethrough with the coincident detection of an absence of the access signal. The control circuitry is also adapted to actuate the speaker upon the receipt of the activation signal via the panic button.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
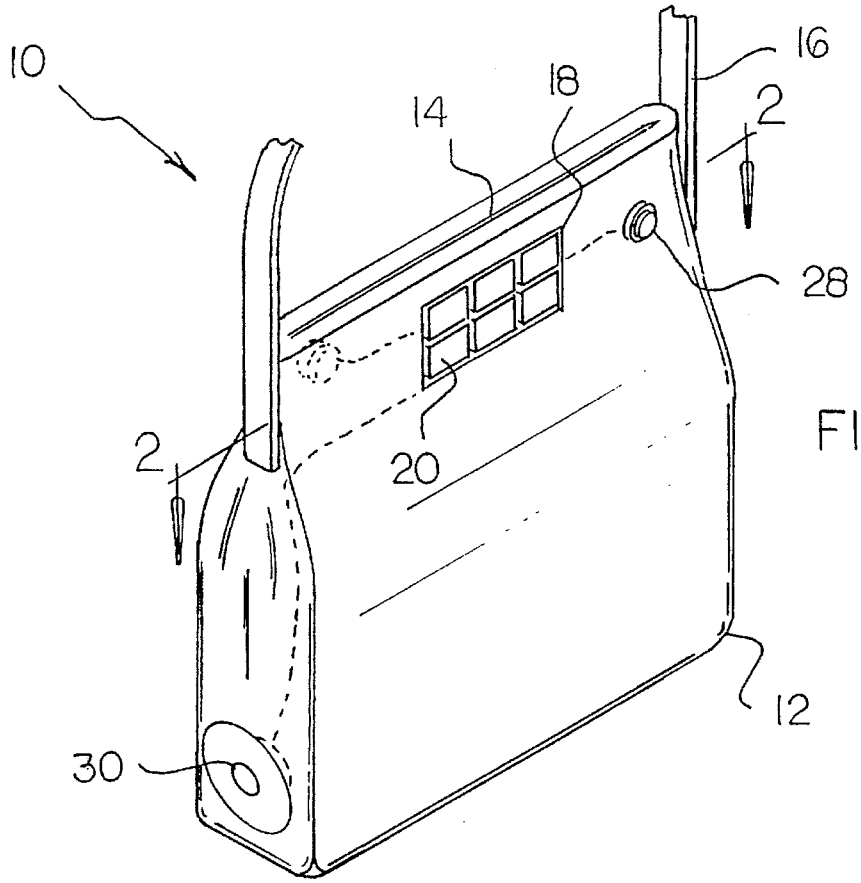
FIG. 1 is a perspective illustration of the preferred embodiment of the theft preventive purse constructed in accordance with the principles of the present invention.
Figure 2:
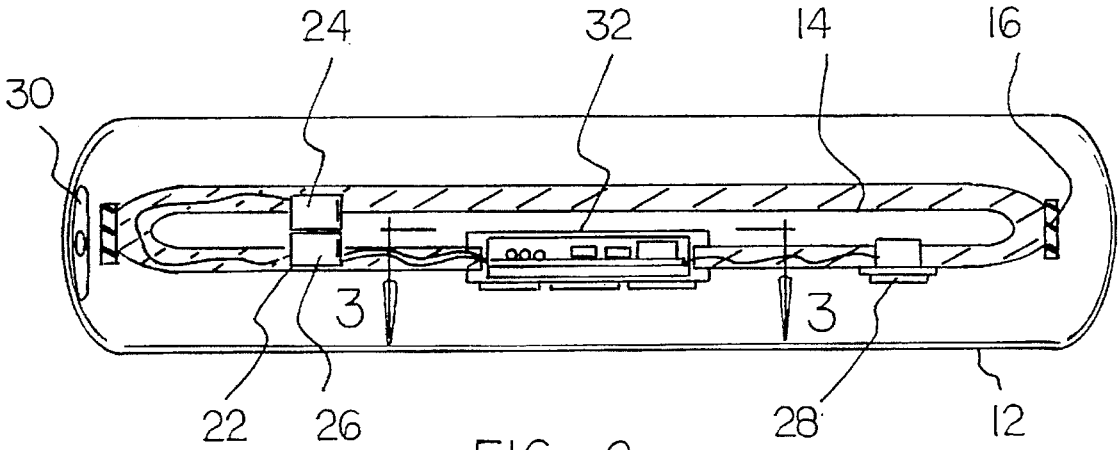
FIG. 2 is a cross-sectional view of the present invention taken along line 2—2 shown in FIG. 1.
Figure 3:
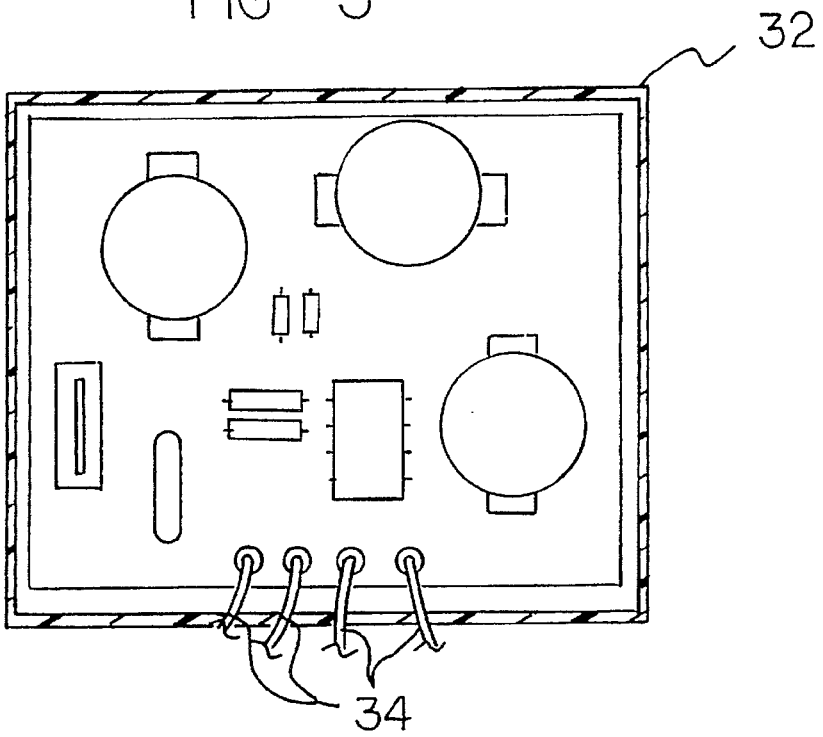
FIG. 3 is a cross-sectional view of the circuitry taken along line 3—3 depicted in FIG. 2.
Figure 4:
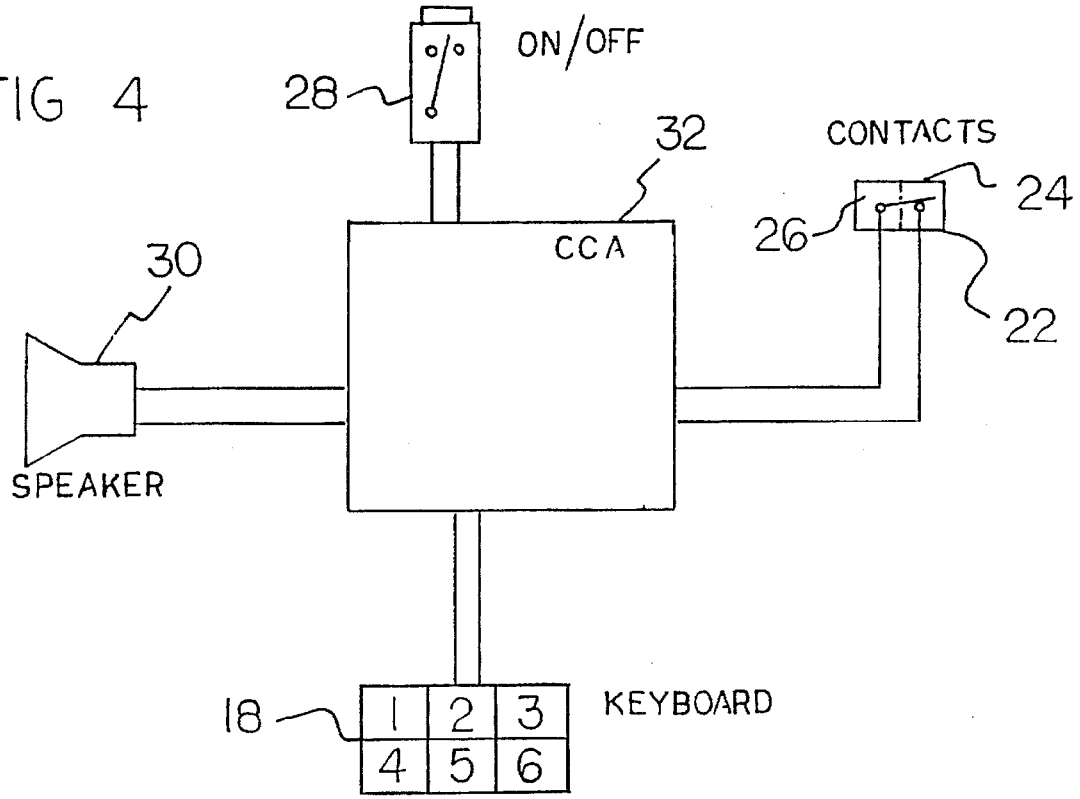
FIG. 4 is a schematic diagram depicting the interconnection of the major components of the present invention.

With reference now to the drawings, and in particular to FIG. 1 thereof, a new and improved theft preventive purse embodying the principles and concepts of the present invention and generally designated by the reference numeral 10 will be described.

The present invention, the new and improved theft preventive purse, is comprised of a plurality of components. Such components in their broadest context include a purse, keypad, trip switch, panic button, speaker, and control circuitry. Such components are individually configured and correlated with respect to each other so as to attain the desired objective.

More specifically, it will be noted that the system 10 of the present invention includes a purse 12 with a generally rectangular configuration having a front face, a rear face, a bottom surface, and a pair of side edges formed therebetween defining an interior space. The purse comprises an openable access slit 14 formed between the front face and rear face at an upper extent thereof. For carrying purposes, a handle 16 is coupled to and extended upward from the side edges of the purse.

Also included is a keypad 18 comprising a plurality of numerical keys 20 situated on the front face of the purse adjacent to the slit. The keypad is adapted to transmit an access signal for a predetermined amount of time upon the depression of a predetermined set of keys in succession. Ideally, the set of keys includes a 3-digit code which reduces the time required to access the purse while still affording a code which is not easily deciphered.

Discreetly situated within the interior space of the purse is a trip switch 22. The trip switch comprises a first contact 24 coupled to an inner surface of the front face adjacent to the slit. A second contact 26 is coupled to an inner surface of the rear surface adjacent to the slit whereby the contacts abut upon the closure of the slit thus allowing current to pass therebetween.

A panic button 28 is positioned on the front face of the purse adjacent to the slit. The panic button is adapted to emit an activation signal upon the depression thereof.

Further included is a speaker 30 situated on one of the side edges of the purse. Upon the actuation thereof, the speaker is adapted to deploy a loud audio signal therefrom.

Finally, control circuitry 32 is situated within the interior space of the purse and electrically connected to the keypad, trip switch, panic button, and speaker via a plurality of discreet control lines 34. Preferably, the control circuitry is incorporated integrally with the keypad in order to minimize the need for space. In such an orientation, the control circuitry and keypad have a combined height of approximately 3 inches, a length of approximately 3 inches, and a width of approximately ¼ of an inch. The control circuitry is adapted to apply a voltage to the trip switch and further actuate the speaker upon the detection of an absence of current therethrough with the detection of a coincident absence of the access signal. Also, the control circuitry is adapted to actuate the speaker upon the receipt of the activation signal via the panic button.

Figure 5:
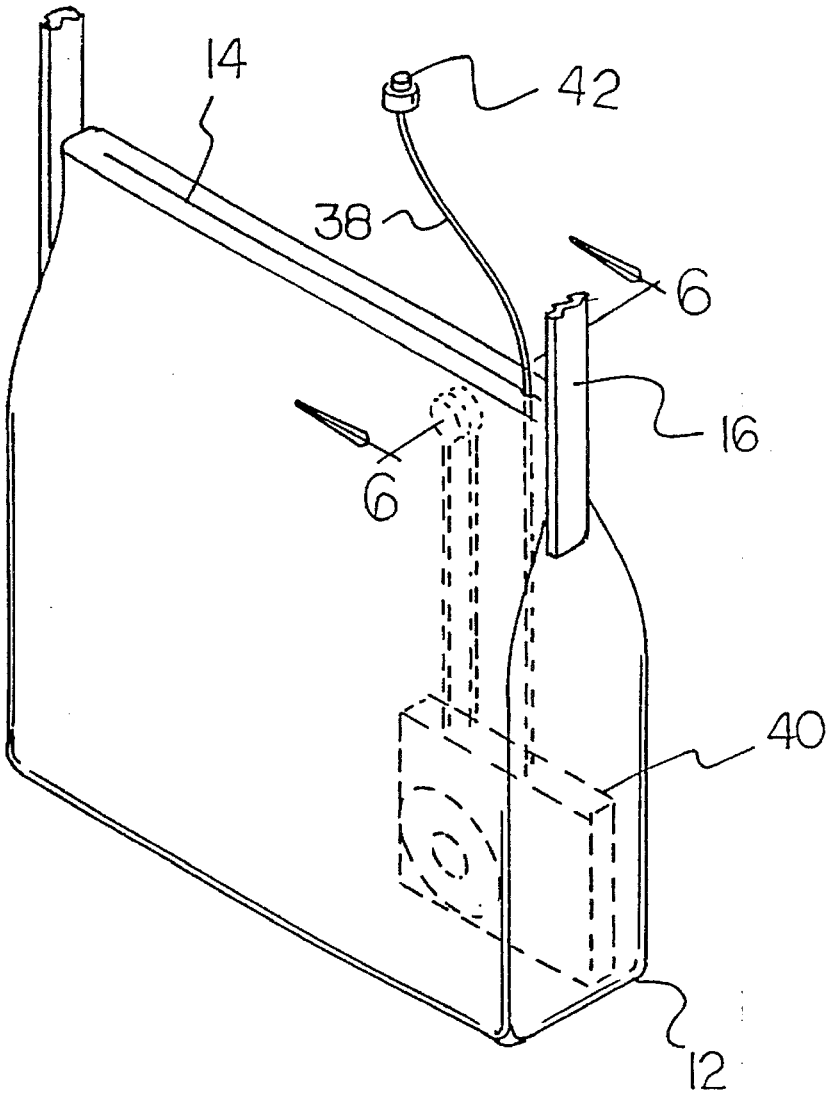
FIG. 5 is a perspective view of an alternate embodiment of the present invention.
Figure 6:
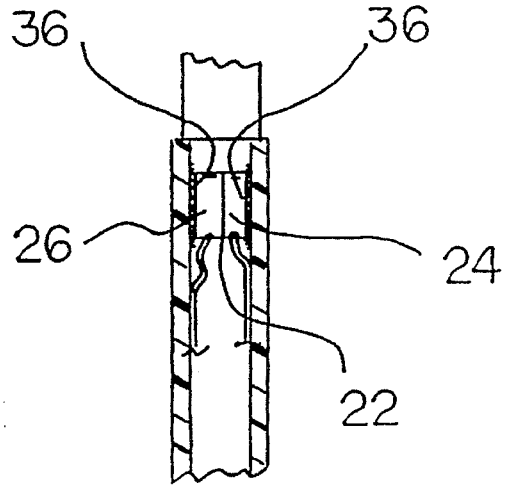
FIG. 6 is a cross-sectional view of the trip switch and associated pile fasteners of the alternate embodiment taken along line 6—6 shown in FIG. 5.

As best shown in FIGS. 5 & 6, an alternate embodiment of the present invention includes all the major components of the preferred embodiment except for the keypad. A pair of pile fasteners 36 are included to easily retrofit the trip switch to any existing purse. Further, a discreet actuator button 42 is connected to the control circuitry in lieu of the keypad via an elongated wire 38 so as to allow the depression thereof at a location exterior to the purse. Upon the depression of the actuator button, the system is temporarily disabled in order to allow access to the purse. In the alternate embodiment, the actuator button may be discreetly attached to the handle of the purse. Lastly, the speaker and control circuitry are incorporated within a single unit 40 which may be discreetly situated within the purse.

In use, the theft preventive purse provides a novel method of preventing the theft of a purse. To access the purse, a user merely enters a 3-digit code via the keypad and within a predetermined amount of time opens the purse. After the purse has been opened for an extended amount of time, a quiet alarm signal is deployed via the speaker to indicate to the user that the contacts are not properly connected. Such a feature prevents the system from remaining deactivated if the user inadvertently fails to properly close the opening of the purse. The panic button operates independently of the trip switch and may be depressed regardless of the orientation of the purse. The panic button thus may be employed to either prevent theft of the purse or a possible attack on the user. Upon the actuation of the speaker, the loud audio signal may be ceased only by entering the 3-digit code via the keypad.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved theft preventive purse comprising, in combination:

a purse with a generally rectangular configuration having a front face, a rear face, a bottom surface, and a pair of side edges formed therebetween defining an interior space, the purse comprising an openable access slit formed between the front face and rear face at an upper extent thereof and a handle coupled to and extended upward from the side edges of the purse for carrying purposes;

a keypad comprising a plurality of numerical keys situated on the front face of the purse adjacent to the slit, the keypad adapted to transmit an access signal for a predetermined amount of time upon the depression of a predetermined set of keys in succession, the predetermined set of keys including a 3-digit code;

a trip switch discreetly situated within the interior space of the purse, the trip switch comprising a first contact coupled to an inner surface of the front face adjacent to the slit and a second contact coupled to an inner surface of the rear surface adjacent to the slit whereby the contacts abut upon the closure of the slit thus allowing current to pass therebetween;

a first pile fastener for securing the first contact of the trip switch in a proper operable orientation and a second pile fastener for securing the second contact of the trip switch in a proper operable orientation;

a panic button positioned on the front face of the purse adjacent to the slit, the panic button adapted to emit an activation signal upon the depression thereof;

a speaker situated on one of the side edges of the purse and adapted to deploy a loud audio signal upon the actuation thereof; and control circuitry situated within the interior space of the purse and formed integrally with the keypad and electrically connected to the keypad, trip switch, panic button, and speaker via a plurality of discreet control lines, the control circuitry adapted to apply a voltage to the trip switch and further actuate the speaker upon the detection of an absence of current therethrough with a coincident detection of an absence of the access signal, the control circuitry also adapted to actuate the speaker upon the receipt of the activation signal via the panic button independently of the orientation of the contacts, the control circuitry adapted to deploy a quiet alarm via the speaker upon the purse being open for longer than a predetermined amount of time for preventing the purse from remaining disarmed if a user inadvertently fails to properly close the opening of the purse, whereby the speaker is adapted to emit the loud signal until the 3-digit code is entered via the keypad;

said control circuitry having a height of approximately 3 inches, a length of approximately 3 inches, and a width of approximately ¼ of an inch.

* * * * *